United States Patent [19]

Buck et al.

[11] 4,273,332

[45] Jun. 16, 1981

[54] TOY RACING APPARATUS

[75] Inventors: Gordon H. Buck, Torrance; Kenneth I. Amamoto, Los Angeles, both of Calif.

[73] Assignee: Mattel, Inc., Hawthorne, Calif.

[21] Appl. No.: 69,035

[22] Filed: Aug. 23, 1979

[51] Int. Cl.[3] ..... A63F 9/14; A63H 17/42

[52] U.S. Cl. ..... 273/86 R; 43/62; 46/1 K; 46/202

[58] Field of Search ..... 273/86 R, 86 B, 86 C; 46/1 K, 202; 43/62; 100/211; 220/377

[56] References Cited

U.S. PATENT DOCUMENTS

| | | | |
|---|---|---|---|
| 49,923 | 9/1865 | Rex | 43/62 |
| 1,374,844 | 4/1921 | Flatow | 273/86 C X |
| 1,987,496 | 1/1935 | Springborn | 273/157 R |
| 2,682,130 | 6/1954 | Schumann | 43/62 |
| 3,751,847 | 8/1973 | Neuhierl | 46/1 K |

*Primary Examiner*—Anton O. Oechsle

[57] ABSTRACT

An apparatus for determining the order of finish of a race involving toy vehicles. The apparatus includes a base which connects to tracks on which vehicles race and has a resilient surface covering its interior. A transparent cover is hinged above the base and has a trigger which is actuated by the leading vehicle crossing the resilient surface to close the cover on the vehicles within the base thereby determining their positions.

2 Claims, 5 Drawing Figures

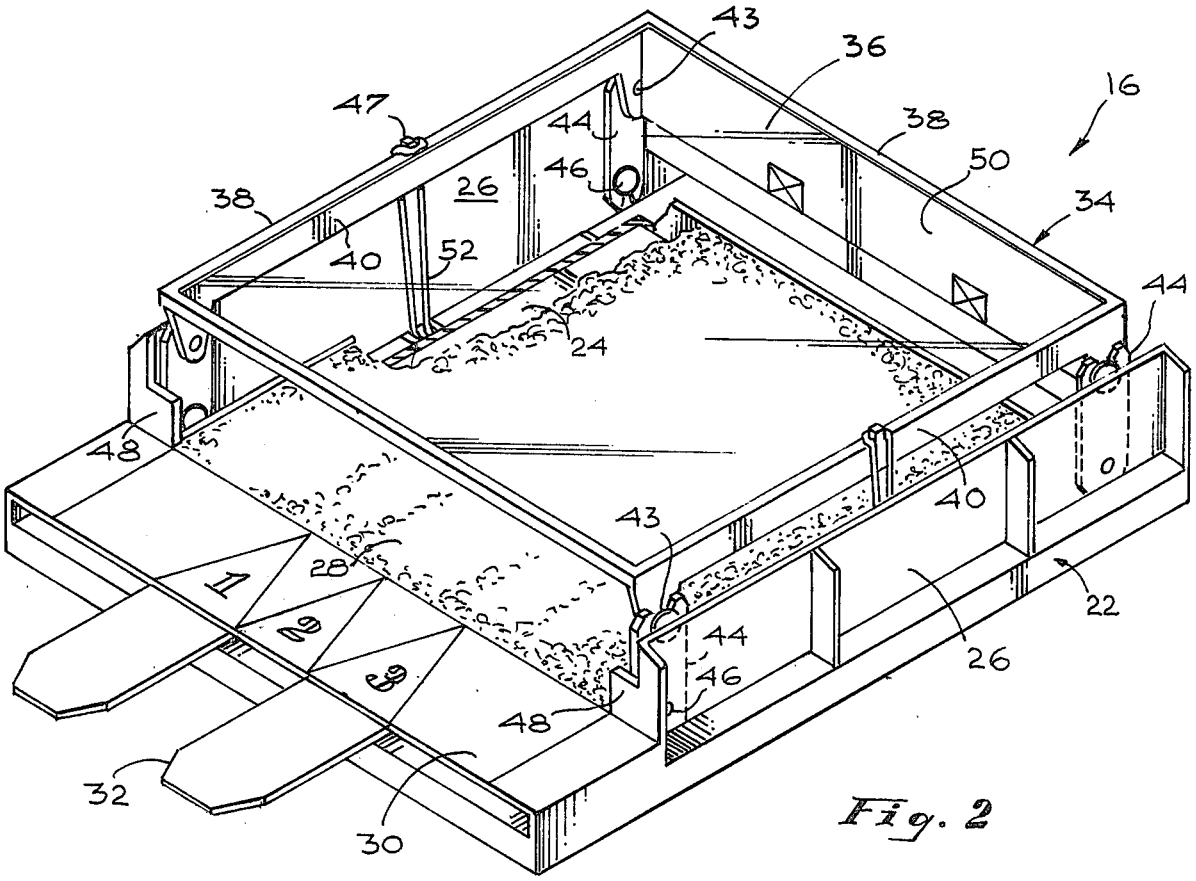
Fig. 2
Fig. 4
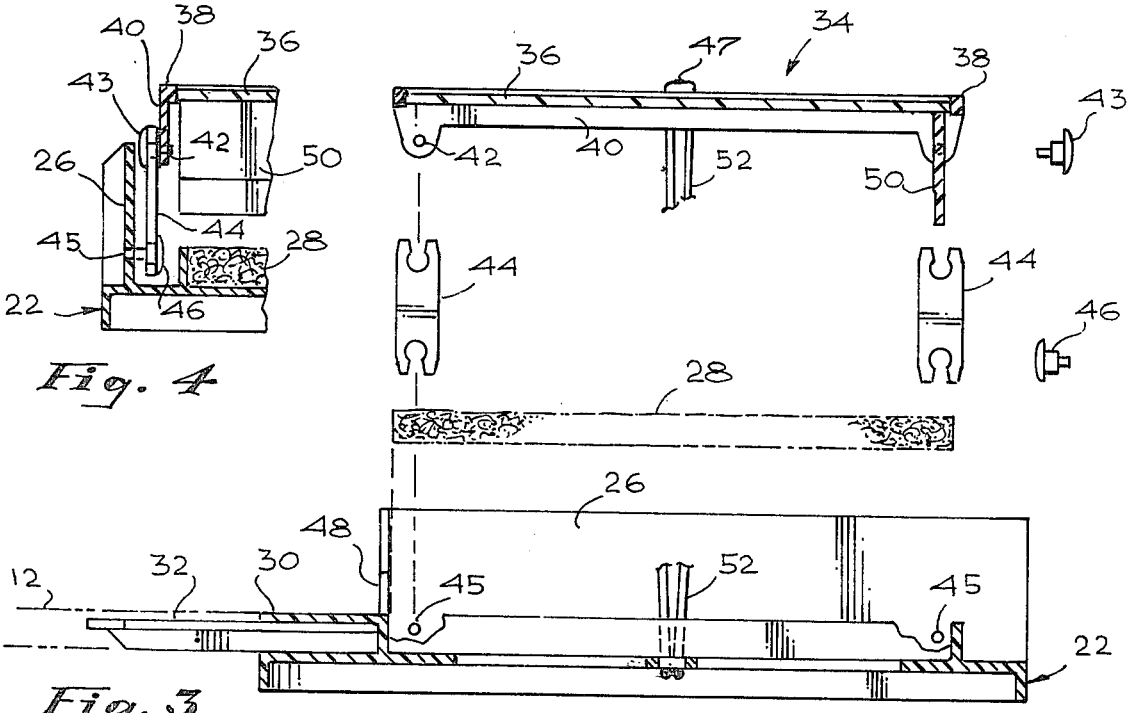
Fig. 3

TOY RACING APPARATUS

BACKGROUND OF THE INVENTION

The background of the invention will be discussed in two parts:

1. Field of the Invention

This invention relates to toys and, more particularly, to apparatus which may be used with racing tracks for toy automobiles.

2. Description of the Prior Art

There has been a myriad of toys developed over the years for use by children of all ages. Many of these toys have become classics and have been reproduced again and again. Those toys which have continued to entrance children over long periods have certain common characteristics. First, they provide a substantial amount of excitement for the child. Second, they are well made and durable. Next, they are sufficiently inexpensive and they appeal to a broad market. Finally, and especially more recently, such toys are safe to use. Meeting all of these criteria has posed substantial problems for many prior art toys.

A popular type of toy includes a gravity or motor powered vehicle which moves down an inclined track, gaining substantial speed, and negotiates some form of racing track layout. Often, two or more such vehicles are raced on adjacent tracks to provide competitive excitement. Although such arrangements can be quite exciting, the rapid action often creates a situation in which it is quite difficult to determine the winner of the competition.

It is an object of this invention to provide a new and improved toy racing apparatus.

It is another object of this invention to provide an inexpensive device capable of determining the winner of a race between a number of toy vehicles.

It is another object of this invention to provide a device which is capable of determining the winner of competition between toy vehicles although the vehicles be of different sizes and weights.

An additional object of this invention is to provide an exciting, inexpensive, durable, and safe toy racing apparatus.

SUMMARY OF THE INVENTION

The foregoing and other objects of the invention are accomplished by toy racing apparatus which includes a base which connects to the ends of at least two tracks on which the vehicles may be raced. A resilient surface covers the interior of the base, and a transparent cover is held in place above the base on rotating linkages by resilient springs. The cover has a trigger mechanism for causing the transparent cover, urged by the springs, to fall upon toy vehicles moving across the base when the trigger mechanism is operated. As the transparent cover falls upon cars traversing the base, it causes each to stop in its most advanced position thereby determining the competitive positions at the end of a race.

Other objects, features, and advantages of the invention will become apparent from a reading of the specification taken in conjunction with the drawings in which like reference numerals refer to like elements in the several views.

BRIEF DESCRIPTION OF THE DRAWINGS

FIG. 2 is a perspective view of a toy racing apparatus constructed in accordance with the invention;

FIG. 3 is an exploded side view of the invention shown in FIG. 2;

FIG. 4 is a rear view of a fragment of the toy racing apparatus illustrated in FIG. 2 showing details of construction of the invention.

DESCRIPTION OF THE PREFERRED EMBODIMENT

Figure 1:
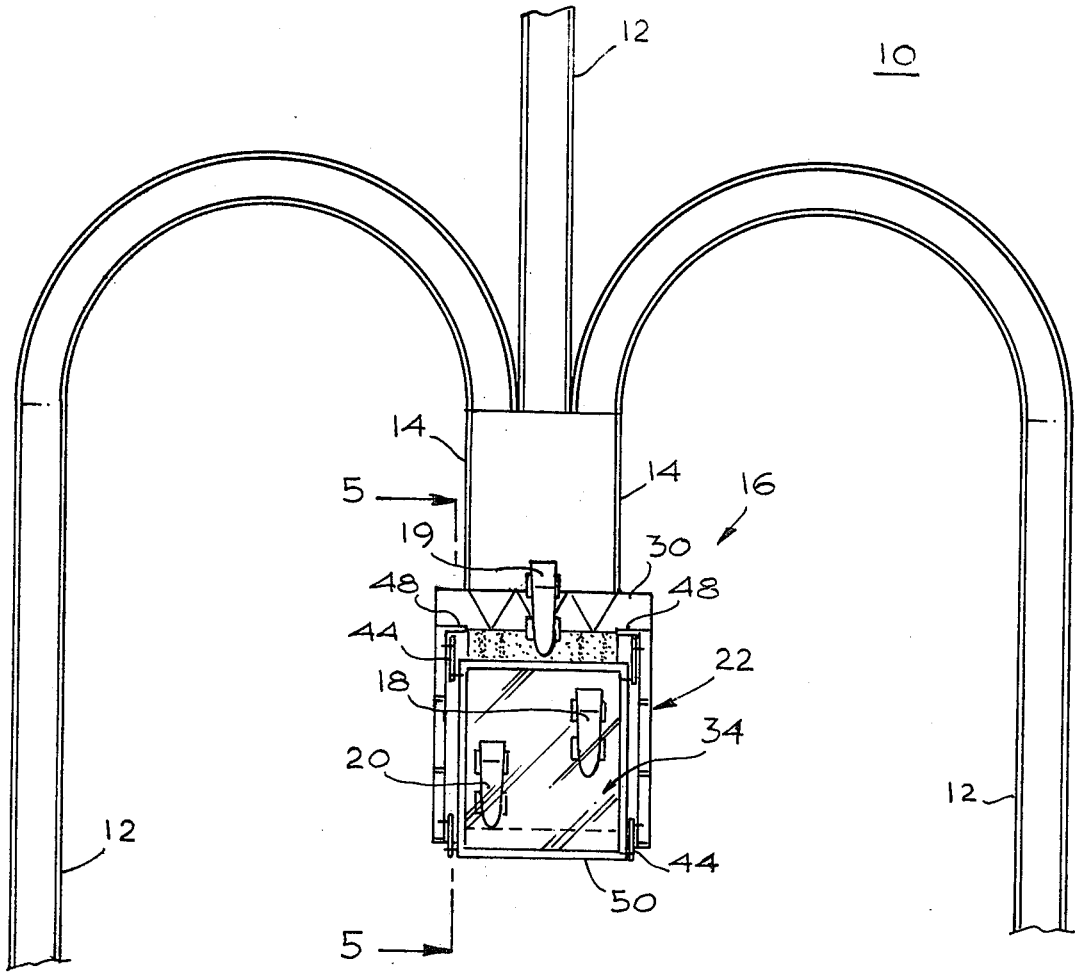
FIG. 1 is a top view of a toy racing track including a toy racing apparatus constructed in accordance with the invention.

Referring now to the drawings, and more particularly, to FIG. 1, there is shown a top view of a toy race track 10 constructed in accordance with the invention. The toy track 10 includes three narrow tracks sections 12 (although more or less may be used) which may be of substantially equal length and each of which connects to a wide track section 14. If used with gravity powered cars, each of the sections 12 will be elevated at its end opposite the section 14 to provide an incline. Each of the track sections 12 and 14 may comprise a number of individual shorter track sections which join together. Such sections are well-known to the prior art and are available commercially. The individual track sections of the larger track sections 12 and 14 may be connected together by various means also well-known in the art. Normally, the track sections 12 and 14 and the means for joining them will be constructed of molded plastic materials.

The track section 14 joins to a toy racing apparatus 16 constructed in accordance with this invention which is used to determine the winner of races run between vehicles on the track sections 12. The toy racing apparatus 16 is boxlike in form, has a transparent top, and is shown in FIG. 1 with three vehicles 18, 19, and 20 positioned therein as such vehicles might be positioned at the end of a race.

In the usual racing situation, gravity powered or motor powered vehicles placed on the track section 12 and released would proceed through each track section 12, manipulate any curves therein, pass through the track section 14, and be stopped by the apparatus 16 at positions which depend upon their finishing positions in the race.

FIG. 2 is a perspective view showing in more detail the toy racing apparatus 16 which is used to determine the finishing positions of the cars racing against one another. FIG. 3 is an exploded side view of the toy racing apparatus 16 shown in FIG. 2. Both of these figures should be referred to for ease of understanding the following description. The apparatus 16 includes a base section 22 which is generally rectangular in shape and has a recessed generally rectangular inner portion 24 separated by a pair of sidewalls 26. The depth of the recess 24 is sufficient to accomodate variations in the height of vehicles racing on the different track sections. The recess 24 may be provided with a cushioning material such as a sponge rubber or foamed plastic material which is generally resilient or sponge-like in nature. The pad 28 is of a thickness so that its top surface is essentially level with the upper lip of an approach 30. The approach 30 joins the wider track section 14 and may be connected thereto by connectors 32 of a type well-known in the art. The approach 30 is aligned so that vehicles negotiating the track section 14 will enter the apparatus 16 through an opening between the base 22 and a cover 34.

The cover 34 has an upper window 36 of a transparent material which is supprted in a frame 38. The window 36 and the frame 38 may be constructed of plastic material. The frame 38 has a pair of sides 40 in each of which are placed a pair of circular apertures 42. Rotatably mounted at each of the apertures 42 by a pin 43 which inserts therein is a link 44 constructed of a plastic material such as Delrin. Each of the links 44 is also rotatably connected at its bottom end by a pin 46 to a circular aperture 45 in one of the sidewalls 26. The pins 43 and 46 are shown rotated by 90° in FIG. 3 so that their shape may be better visualized.

Each of the sides 40 has a projection 47 at its upper midpoint. The sidewalls 26 have, vertically disposed at their left ends, tabs 48 (as seen in FIG. 2) so that in its normal position the cover 34 may be held upright separated from the base 22 with the left most links 44 resting against the tabs 48.

The cover 34 also has mounted to its righthand end and extending downwardly from the frame 38, a trigger 50 which in the preferred embodiment is a sheet of flat plastic material mounted fixedly at its ends to the side members 40 and at its top to the frame 38 so it projects downwardly therefrom. An elastic spring 52 which may be a rubber band is connected to each of the projections 47 of the frame 38 and extends downwardly and around the bottom of the base 22.

The spring 52 is such that it is tightly stretched in the position in which the cover 34 is in the upright position with the links 44 resting against the tabs 48. If the links 44 at other than 90° to the base 22, the spring 52 tends to urge the cover 34 to rotate on the links 44 and collapse against the base 22. However, with the links 44 at 90° to the base 22, this will not happen because the spring force is directly in line with the lengthwise axis of links 44.

Figure 5:
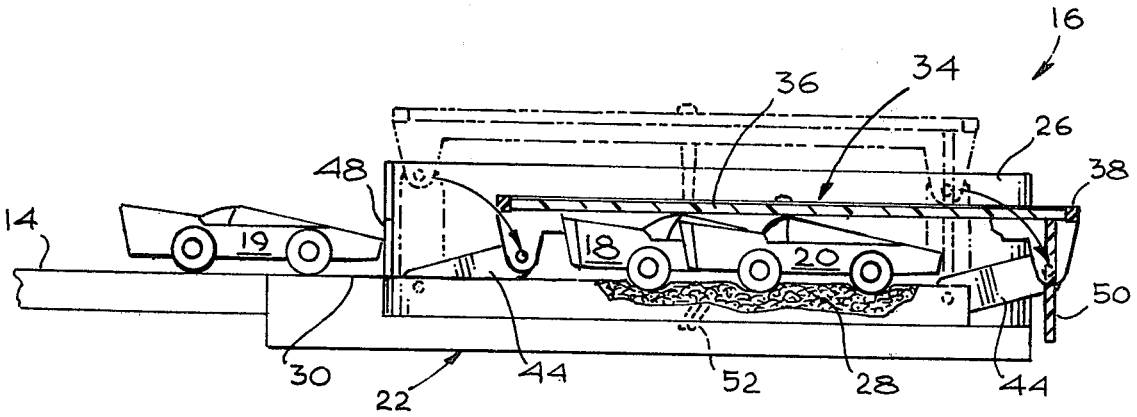
FIG. 5 is a cross-sectional side view of the toy racing apparatus shown in FIG. 1.

When a vehicle proceeds over the approach 30 and crosses the pad 28, it will be slowed by the resiliency thereof and will strike the trigger 50. A force to the right in FIG. 2 against the trigger 50 will cause the cover 34 to rotate on the links 44 downwardly as shown by the arrow at the right-hand end of the cover 34 in FIG. 3. As the cover 34 rotates in this direction, it will fall against all vehicles which may be progressing through the apparatus 16 and will stop those vehicles in positions depending upon their progress through the apparatus 16. Since the recess 24 is chosen to have sufficient thickness for variations in vehicle height, vehicles of different dimensions will all be stopped by pressure from the window 26 on their upper surfaces. In FIG. 5, three vehicles 18, 19 and 20 are shown within the apparatus 16. As the cover 34 rotates to the right and downwardly, the window 36 clamps against the top of each of the vehicles 18, 19, and 20 thereby fixing it in position. In a preferred embodiment, the window 36 may be furnished with scribe marks so that the positions of each car are more clearly shown with respect to one another.

The apparatus 16 has a particular advantage in determining the finishing position of vehicles in a race in that it is able to handle vehicles of different weights with equal effectiveness. The use of the spongy pad 28 and the clamping action of the window 36 upon the top of the vehicles (impelled thereby by the force of the spring 52) assures that a vehicle will be captured in its correct final position even though its weight differs from that of a vehicle against which it is racing.

The apparatus 16 also provides for a positive visual determination of the winning vehicle and eliminates argument which might be caused were flags or the like to drop to mark the winning vehicle. It also clearly indicates the distances separating the various cars. The apparatus of this invention is quite inexpensive, being manufactured of molded plastic parts, and is simple to construct and easy to maintain. The method of stopping by closing the top 34 on racing vehicles provides an especially safe finish for a child's game because it constrains the vehicles so that they cannot injure an operator.

While there has been shown and described a preferred embodiment, it is to be understood that various other adaptations and modifications may be made which fall within the spirit and scope of the invention.

What is claimed is:

1. A toy for determining the final position of toy racing vehicles comprising a base over which toy vehicles may be operated, a cover supported over the base, and means for collapsing the cover onto vehicles traversing the base including a set of linkages rotatably positioning the cover over the base, a spring for placing a downward force on the cover, and trigger means for causing the base to begin rotation in response to a vehicle reaching a particular location on the base, whereby such vehicles come to rest in positions indicative of their positions in a race.

2. A toy for determining race positions comprising a box having a base, a top having a transparent portion for viewing the interior of the box, an opening in the side for admitting racing vehicles, and means for clamping the top on vehicles traversing the base including a set of links each of which is rotatably connected to the top and to the base, a spring tending to urge the top against the base, and means for holding the top apart from the base until a vehicle reaches a particular position in the base.

* * * * *